United States Patent [19]

Shea

[11] 4,194,775

[45] Mar. 25, 1980

[54] FASTENER FOR A PAY TELEPHONE STATION COIN BOX

[76] Inventor: Frank J. Shea, 258 E. Shore Trail, Sparta, N.J. 07871

[21] Appl. No.: 765,532

[22] Filed: Feb. 4, 1977

[51] Int. Cl.[2] ..... B65D 33/34

[52] U.S. Cl. ..... 292/307 R

[58] Field of Search ..... 292/282, 307-313

[56] References Cited

U.S. PATENT DOCUMENTS

| | | | |
|---|---|---|---|
| 625,837 | 5/1899 | Dela Mar | 292/311 |
| 2,902,308 | 9/1959 | Moberg | 292/307 R |

FOREIGN PATENT DOCUMENTS

| | | | |
|---|---|---|---|
| 47758 | 1/1940 | Netherlands | 292/307 R |

*Primary Examiner*—Richard E. Moore

*Attorney, Agent, or Firm*—Patrick J. Roche

[57] ABSTRACT

A fastener for a hasp including a staple and utilized to lock a pay telephone station coin box for preventing unauthorized entry thereinto, and comprising a first element formed in an E-shape or an ∃-shape and having a middle projection positioned in the interior space of the staple for disposing the latter element adjacent to the hasp member attached to the face of the box, and a second element formed with an opening through which the free end of the staple is passed to dispose the latter element exteriorly of the staple with one surface in juxtaposition with an opposite surface of the first element. The juxtapositioned surfaces may be plain or provided with predetermined, mated projections, including the first-mentioned projections, grooves and recesses bonded together to constitute a bielement unitary fastener difficult to remove from the hasp without showing evidence of tampering with the fastener.

27 Claims, 18 Drawing Figures

FIG. 1
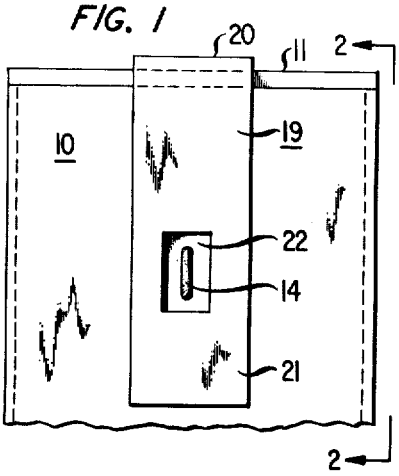
FIG. 2
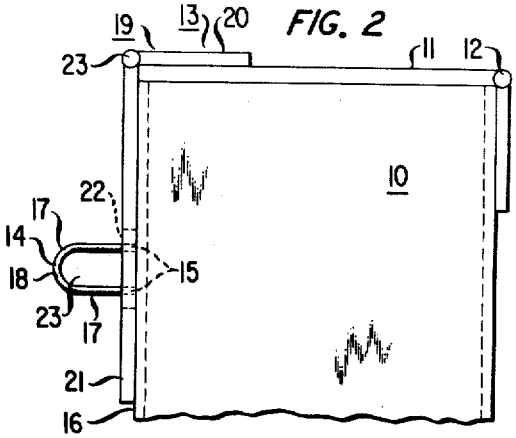
FIG. 3
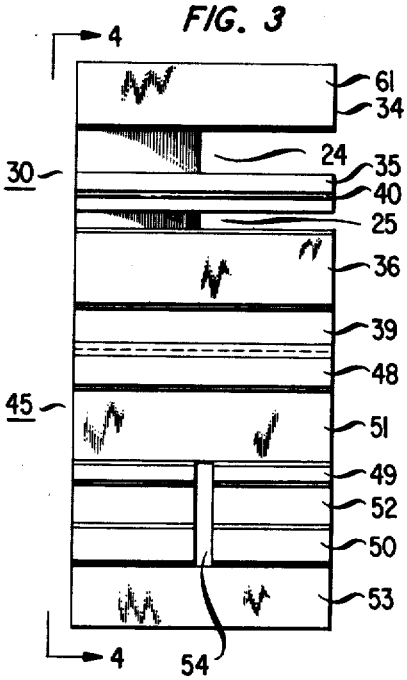
FIG. 4
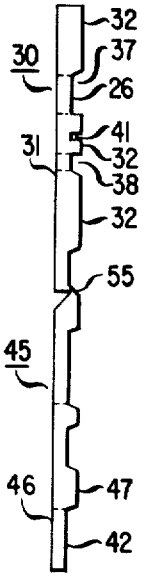
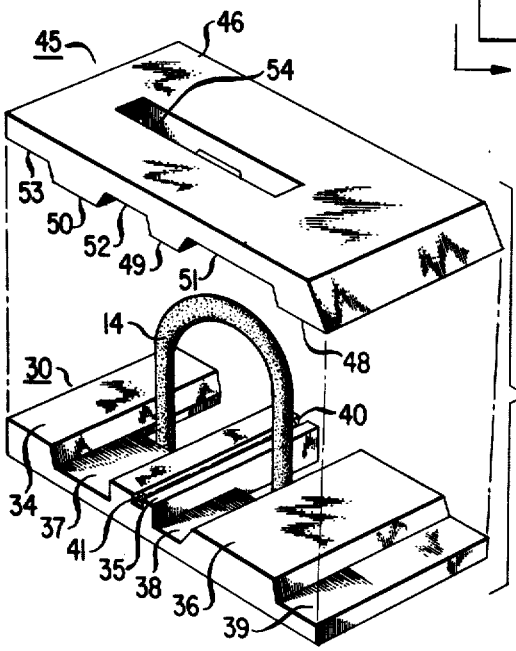
FIG. 5

FASTENER FOR A PAY TELEPHONE STATION COIN BOX

BACKGROUND OF THE INVENTION

This invention relates to a fastener for locking a coin box used in a pay telephone station, and more specifically to such fastener for preventing unauthorized entry into the interior of the coin box during its use in the pay telephone station in the field and its removal therefrom and its arrival at the accounting department of a telephone company for evaluating its coin content.

Heretofore, the handling of coin boxes during their uses in pay telephone stations in the field and after their removal from such pay telephone stations and their check-in at the telephone company accounting department for auditing purposes has been the source of much concern to telephone companies. In the past, locks of many types have been designed to seal the coin boxes and at the same time strict surveilance has been observed along the routes of travel of the coin boxes from the pay telephone stations in the field to the telephone company accounting department. Still, after such precautions, accountings of the monetary values of the coins collected in the coin boxes have shown variations from the estimated value that should be in the boxes in relation to the number and types of calls originated at the respective pay telephone stations. Sophisticated personnel handling the coin boxes on such routes with intent on larceny have been known to gain access into the interiors of the coin boxes and to pilfer some coins, but not all, therefrom without leaving any evidence on the locks to indicate tampering therewith. This pilfering has resulted in losses of substantial dollar amounts to the telephone companies.

It is therefore contemplated by the present invention to provide a fastener for a coin box used at a pay telephone station to thwart unauthorized entry into the box either at the latter station or as the coin box is being transported from the pay telephone station in the field to a telephone company accounting department for evaluating the coin content in the box. Initially, upon its arrival at the accounting department a careful examination of the fastener enables the accounting personnel to render a quick determination as to whether the fastener was tampered with during its use or travel in the field. Accordingly, the fastener, according to the present invention, tends to increase the risk of detection of personnel handling the coin box and surrendering to a larcenous intent to pilfer some of the coins therefrom.

It is therefore a principal object of the invention to thwart unauthorized entry into the interior of a pay telephone station coin box in the field or in transit therefrom to the telephone company for an accounting of the coin content of the box upon its arrival thereat.

Another object is to curb the pilfering of coins from a pay telephone station coin box during and after its use in the field but before an accounting of its coin content at the telephone company.

An additional object is to minimize dollar loss to a telephone company resulting from the pilfering of coins from a coin box during its use in the field and after its removal from a pay telephone station in the field for delivery to the telephone company accounting department.

A still additional object is to increase the dollar amount derived from the operation of a pay telephone station in a telephone system.

A further object is to discourage attempts to pilfer coins from a coin box used in a pay telephone station by personnel handling the box before an accounting of the coin content thereof.

SUMMARY OF THE INVENTION

The foregoing and other objects of the invention are achieved in accordance with a specific embodiment thereof shown in FIGS. 3 through 8, 10 and 11 and illustrating a fastener for a coin box used in a pay telephone station in the field to indicate evidence of tampering merely upon a cursory inspection of the fastener at any time while it is still attached to the coin box in the latter station and after its removal therefrom for delivery to the accounting department of a telephone company for auditing purposes.

The fastener involves a bonded bielement unitary structure interconnected with a staple utilized with a hasp joining the coin box cover with an adjacent face of the coin box. The fastener includes a first element formed with at least three coextensive elongated, parallel, and rectilinear projections positioned in spaced relation on the staple so that a middle projection is disposed in the internal space of the staple while two adjacent projections are disposed externally thereof in one plane with the middle projection and further so that one surface of the first element lies adjacent to a member of the hasp contiguous with the adjacent face of the coin box and a surface opposite to the latter one surface is disposed toward the free end of the staple. The first element has essentially an E-shape.

The fastener also includes a second element formed in a rectangular shape with an aperture for passing the free end of the staple therethrough to dispose one surface of the second element in juxtaposition with the opposite surface of the first element on the staple. The juxtaposed surfaces are provided with coextensive, elongated, parallel and rectilinear projections including the first-mentioned three projections, grooves and recesses of predetermined locations for enabling mating between these surfaces to constitute the fastener in a bielement structure. A suitable adhesive supplied to at least one of the two juxtaposed surfaces, or both latter surfaces as desired, bonds the latter surfaces together to constitute the fastener bielement structure as unitary.

An elongated pin of hard material embodied in the first element middle projection adds strength to the fastener unitary structure. Obviously, the first element may be selected of hard material thereby obviating the use of the elongated pin.

The invention contemplates the first element usable in an inverted position, i.e., in the ∃-shape. This requires that the second element also be inverted on the staple.

In a modification, the juxtaposed surfaces of the E-shape and the ∃-shape first element and of the second element are plane. In another modification, the first element is formed in a ⊢ or ⊣ shape in which the projection of longer dimension is disposed in the internal space of the staple from either the left or righthand side thereof. The second element is also formed in a ⊢ or ⊣ shape or in the rectangular shape and is disposed externally of the staple. In the two modifications, the projection of the first element in the internal space of the staple is bonded to the second element disposed externally of the one end of the staple to constitute the fastener structure as unitary.

It would thus appear that the fastener in a bonded bielement unitary structure is irremovably attached to the hasp assembled on the coin box in use in a given pay telephone station. As a consequence, any attempt to gain unauthorized entry into the interior of the coin box during its use in or after its removal from a pay telephone station in the field would leave some evidence of such attempt on the fastener. Additionally, it would appear that a partial or complete destruction of the fastener is the only route available to larcenous personnel bent on gaining unauthorized entry into the interior of the coin box for the purpose of pilfering coins therefrom. Thereafter, identification of such personnel would be a simple matter resulting from a sophisticated investigation of such destruction. It is therefore suggested that the fastener according to the invention curbs, if not eliminates, the pilfering of coins from coin boxes in use or in transit from a pay telephone station in the field to the accounting department of a telephone company for the purpose of auditing the coin content of the coin box. This minimizes dollar loss to the telephone company while at the same time increases the dollar profit from the operation of pay telephone stations in the field.

BRIEF DESCRIPTION OF THE DRAWING

The invention will be readily understood from the following description when taken together with the accompanying drawings in which:

FIG. 1 is a partial front elevational view of a familiar type of hasp assembled on a coin box of common structure used in a pay telephone station;

FIG. 2 is a partial side elevational view taken along line 2—2 in FIG. 1;

FIG. 3 is a plan view of a specific embodiment of the invention usable in FIGS. 1 and 2;

FIG. 4 is a side elevational view taken along line 4—4 in FIG. 3;

FIG. 5 is an exploded view illustrating action obtainable with FIGS. 3 and 4 in FIGS. 6, 7, 8, 10, and 11;

DETAILED DESCRIPTION

Figure 6:
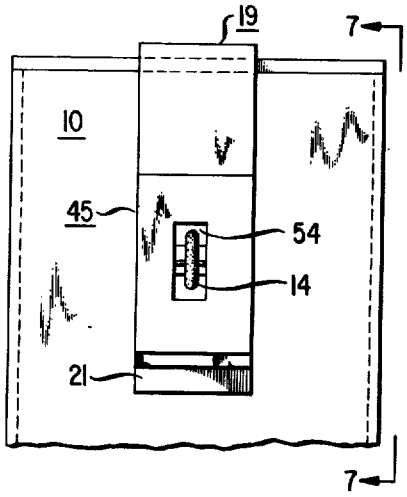
FIGS. 6 and 7 are similar to FIGS. 1 and 2, respectively, except the two former embody the specific embodiment of the invention in FIGS. 3 and 4.

FIGS. 1 and 2 show a conventional type of coin box used in a pay telephone station for receiving and accumulating coins dropped thereinto in payment of telephone calls as initiated and completed. This station is usually available at public places, such, for example, as hotels, railroad stations, and the like. For the purpose of simplifying the instant disclosure, the pay telephone station, per se, is not shown with box, as it is not directly pertinent to the invention described herein. Also, the pay telephone station is well-known to the public at large in regard both as to its function and operation for receiving and evaluating coins dropped thereinto for the payment of the aforesaid calls.

After each call is completed to the satisfaction of the user and the telephone operator as signaled by the return of the receiver to on-hook, the pay telephone station is activated to pass along to the coin box the coins tentatively dropped thereinto to initiate each call as well as thereafter the additional coins dropped into the pay telephone station to pay the ultimate cost of the call. From time to time pursuant to a prearranged time schedule, a telephone company representative removes the coin box from the pay telephone station and returns it to the telephone accounting office for an evaluation in dollar amount of the coins in the coin box. At this removal, an empty box is inserted into the pay telephone station for use in the next succeeding time period.

In FIGS. 1 and 2, coin box 10 comprises cover 11 rotatable via pivot 12 to enclose and expose the interior of the box as desired. As shown, the cover is positioned to enclose the interior of the box. This is also supplied with a familiar hasp 13 embodying a staple 14 having first two spaced adjacent ends 15,15 suitably secured to a front face of the box and a second two spaced adjacent ends 17,17 oppositely disposed to the respective first two ends and terminated in an integral curvilinear segment 18. Staple interior space 23 is enclosed via the box face, staple ends 15,15 and 17,17 and the integral segment for a purpose that is later mentioned.

The hasp also embodies a member 19 having one end 20 suitably attached to the box cover and an opposite end 21 formed with a slit 22 for receiving therethrough the staple integral segment as the member end 21 is rotated on pivot 23 in a counter-clockwise direction to dispose the latter end on the staple in a position adjacent to staple ends 15,15 and the box face for assembling the hasp on the box to enclose the interior thereof. Obviously, member end 21 is rotatable in a clockwise direction on pivot 23 to effect its removal from the staple for exposing the interior of the box.

Heretofore, devices for locking the hasp as assembled on the box to seal off the interior thereof from unauthorized entry were somewhat easily manipulated and removed, and later replaced, from the hasp to gain access to the interior of the box during its use and after its removal from its associated pay telephone station but before its return to the telephone company for an accounting of the dollar amount represented by the coins collected in the box. Such entry usually resulted in the pilfering of some of the coins but not all of them from the box. This was discovered subsequently at the telephone company accounting office where the box was returned and where the coin content was evaluated against the dollar value that should be there in relation to the number and types of calls made at the pay telephone station from which the box was taken. One difficulty with the prior locking devices is that in most instances of such unauthorized entry little or no evidence showing tampering with the locking devices was left behind. Considering the number of pay telephone stations distributed throughout the great metropolitan areas, such continuous pilfering of coins from the coin boxes as they are used in the field or transported from the pay telephone stations to the telephone accounting office, or even at the latter, constitutes in the aggregate large sums of money. This is a serious problem for which the telephone company is constantly seeking a solution.

In accordance with a specific embodiment of the invention, the fastener for locking the hasp as assembled on the box in FIGS. 1 and 2 renders it difficult for personnel with larcenous intent to gain unauthorized access to the interior of the coin box either in use in the field, or enroute from the pay telephone station from which it was removed in the field to the telephone accounting office or at the latter office without the fastener showing some evidence of tampering therewith.

FIGS. 3 and 4 illustrate a specific embodiment of the invention as comprising first and second elements 30 and 45, respectively, of suitable material. First element 30 includes a first plane surface 31 and an opposite second plane surface 32 formed with elongated, rectilinear and coextensive projections 34, 35 and 36 arranged in a mutually parallel relationship with corresponding surfaces lying in a plane coincident with second plane surface 32. First and second legs 24 and 25, respectively, sustaining such relationship are disposed normally to and formed integrally with corresponding ends of the projections 34, 35 and 36 in such manner that leg 24 joins projections 34 and 35 to constitute a first groove 37 therebetween and further in such manner that leg 25 joins projections 35 and 36 to constitute a second groove 38 therebetween. Third projection 36 is provided with an elongated, rectilinear recess 39 extending along a free lengthwise edge thereof. These grooves and the recess have corresponding surfaces lying coincident in a third plane surface 26 intermediate first and second plane surfaces 31 and 32, respectively. Middle projection 35 is formed with an elongated slot 40 extending centrally along its plane surface 32 of long dimension for a purpose that is later mentioned.

Second element 45 comprises a fourth plane surface 46 and an opposite fifth plane surface 47 provided with elongated rectilinear and coextensive projections 48, 49 and 50, which are coextensive with each other and with the respective projections 34, 35 and 36 and are arranged in a mutually parallel spaced relationship with corresponding surfaces lying in a plane coincident with fifth plane surface 47. Third and fourth grooves 51 and 52 formed between opposing lengthwise edges of projections 48 and 49 and 49 and 50, respectively, are coextensive therewith. Sixth projection 50 is provided with a second elongated, rectilinear recess 53 extending along a free lengthwise edge thereof. The latter grooves and recess 53 have corresponding surfaces lying coincident in a sixth plane surface 42 intermediate fourth and fifth plane surfaces 46 and 47, respectively, and are coextensive with the respective projections 48, 49 and 50. Second element 45 also includes an elongated aperture 54 provided lengthwise approximately on a central axis thereof and dividing projections 49 and 50 and groove 52 into two parts for a purpose that is later pointed out.

A strip 55 integral with adjacent ends of elements 30 and 45 serves to connect them together as a unit during manufacture, and is thereafter served to enable their expeditious use as discrete elements in a manner that is subsequently explained.

The operation of the specific embodiment of the invention in FIGS. 3 and 4 with the conventional coin box in FIGS. 1 and 2 is illustrated in FIGS. 5, 6, 7, 8, 10 and 11 wherein preselected element 30 in an E-shape and severed at strip 55 from element 45 is so disposed on the staple that middle projection 35 is positioned interiorly of staple space 23 and outer projections 34 and 36 are positioned exteriorly of the staple. At the same time, plane surface 31 is located adjacent to member end 21 at staple ends 15,15 and surface 32 containing the projections, grooves and recess above identified is faced in the direction looking toward the staple curvilinear segment integral with opposite ends 17,17. Further, middle projection 35 has opposite edges positioned adjacent to staple internal opposite portions 55 and 56 and first and second projections 34 and 36 have internal lengthwise edges positioned adjacent to staple external opposite portions 57 and 58, respectively. It is thus seen that the staple internal and external opposite portions as just identified are positioned with preselected E-shape element 30 in one plane located intermediate member end 21 at staple ends 15,15 and staple ends 17,17 integral with the curvilinear segment.

Next, second element 45 is positioned to pass the staple curvilinear segment through its aperture 54 for disposing its surface 47 in juxtaposition with the first element surface 32, both latter surfaces 32 and 47 being substantially coextensive, whereby second and third plane surfaces 32 and 26 are disposed in contiguous relation with sixth and fifth plane surfaces 42 and 47, respectively. This causes the mating of the first element first, second and third projections 34, 35 and 36, respectively, with the second element second recess 53 and fourth and third grooves 52 and 51, respectively, and the second element fourth, fifth and sixth projections 48, 49 amd 50, respectively, with the first element first recess 39, and second and first grooves 38 and 37, respectively. It is thus seen in FIGS. 6 and 7 that the second element is positioned exteriorly of the staple.

Figure 7:
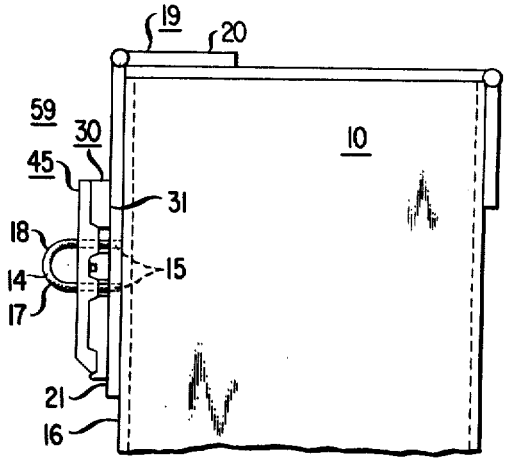

A suitable adhesive 61 distributed over at least one of the juxtaposed surfaces 32 and 47, or both of them if so desired, in FIG. 3 bonds the latter surfaces together to constitute fastener 59 in a bielement unitary structure in FIG. 7 for locking the assembled hasp on the coin box, thereby sealing the interior thereof. As a consequence of such locking of the coin box, it would appear that any larcenous attempt to gain unauthorized access to the interior thereof for the purpose of pilfering coins therefrom would exhibit some evidence of tampering with the fastener. Pin 41 embodied in slot 40 in middle projection 35 serves to reinforce the latter to resist further such tampering with the fastener. This pin may be omitted when the first and second elements are selected of a hard material to resist a breakage force.

Figure 8:
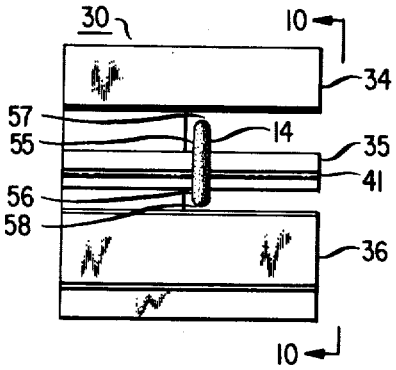
FIG. 8 is a fragmentary view of FIG. 1 shown in enlarged form and embodying a portion of the specific embodiment of the invention in FIG. 3.
Figure 9:
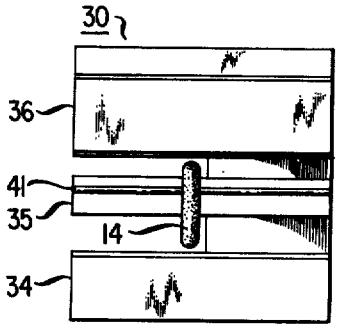
FIG. 9 is a fragmentary view of FIG. 1 shown in enlarged form and embodying the portion of the invention in FIG. 3 inverted from that in FIG. 8.
Figure 10:
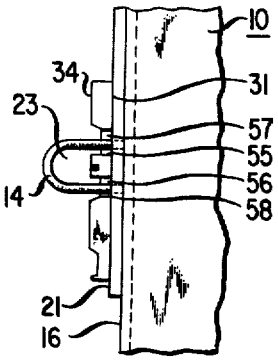
FIG. 10 is a view taken along line 10—10 in FIG. 8.
Figure 11:
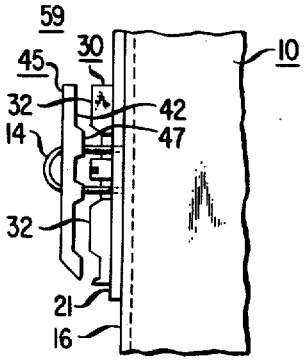
FIG. 11 is a fragmentary view of FIG. 2 showing the specific embodiment of the invention in FIGS. 3 and 4 as used in FIG. 2.

It is evident that first element may be preselected so as to be disposed in a reverse ∃ -shape on the staple as shown in FIG. 9. As this involves an inversion of 180 degrees from that in FIGS. 5 and 8, it is required that the second element also be inverted 180 degrees relative to its disposition in FIG. 5. Again, surfaces 32 and 47 juxtaposed in inserted positions mate the corresponding projections, grooves and recesses, respectively, therein to constitute the structure of the unitary fastener 59 in FIG. 7. Except for the 180-degree inversions of elements 30 and 45 according to FIG. 9, no other change is involved in the structure of bielement unitary fastener 59 according to FIGS. 8 and 11.

In the unitary fastener 59 according to both FIGS. 8 and 9 as just explained, it is evident that the divided projections 49 and 50 and divided grooves 52 mate with the corresponding grooves 38 and 37 and projection 35, respectively on opposite sides of the staple.

FIGS. 12 through 16 delineate a modification of the specific embodiment in FIGS. 3 and 4 in that both opposite surfaces of each of third and fourth elements 65 and 55, respectively, are plane, while the latter fourth element is also formed with the opening 22 in FIG. 3. As these elements may be selected of relatively hard material, slot 40 and pin 41 in first element 30 in FIG. 3 may be omitted from its counterpart element 65 in FIG. 12. The third and fourth elements may be manufactured individually or joined together via strip 67 in FIGS. 12 and 13 which latter strip is cut to permit the respective latter elements to be manipulated separately in the manner of the corresponding elements 30 and 45, respectively, as previously explained.

Figure 12:
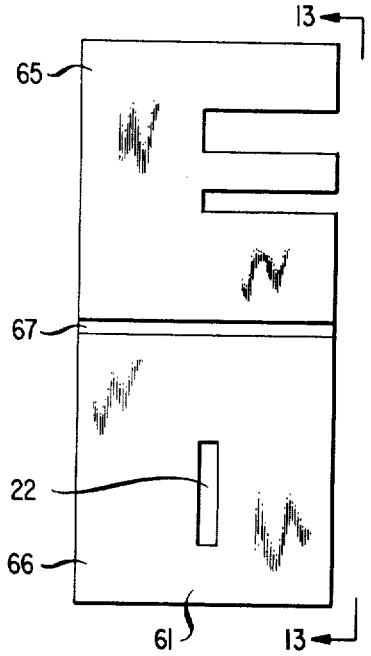
FIGS. 12, 13, 14, 15 and 16 similar to the corresponding views in FIGS. 3, 4, 8, 9, and 11, respectively, delineate modifications of the invention in FIGS. 3 and 4.
Figure 13:
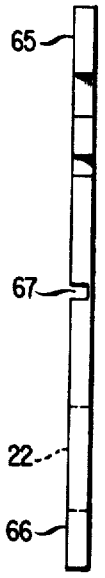
Figure 14:
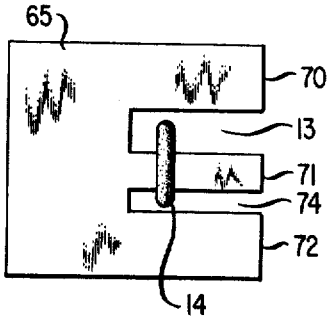
Figure 15:
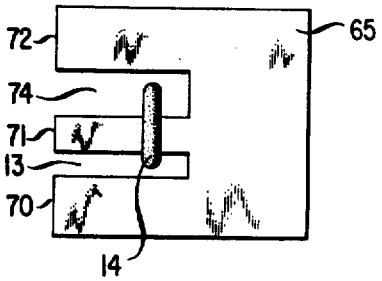
Figure 16:
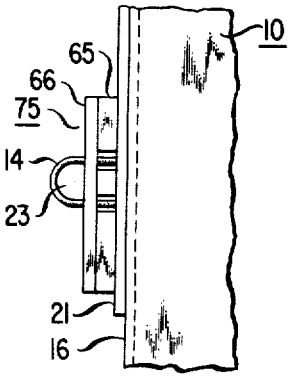

FIGS. 14 and 15 illustrate third element 65 disposed in the E-shape and the inverted ∃ -shape positions, respectively, and fourth element 66 formed with aperture 22 in FIG. 12 in a position usable with the former position but inverted for the latter position. The third element is formed with spaced elongated, rectilinear and coextensive projections 70,71 and 72 of which 70 and 71 and 71 and 72 are separated by elongated openings 73 and 74, respectively, all in spaced mutually parallel relation.

The operation of the modification in FIGS. 12 through 16 is now explained. The third element in its E-shape has its middle projection 71 disposed in hollow internal opening 23 of the staple and its first and third projections 70 and 72, respectively, disposed exteriorly thereof via the respective openings 73 and 74 in FIG. 14. One surface of the third element is positioned adjacent the member opposite end 21 and an opposite surface is faced to the staple segment. The fourth element in FIG. 12 is positioned on the staple by passing the staple curvilinear segment through its opening 22 to dispose one surface of the latter element in juxtaposition with the adjacent opposite surface of the third element. Again, at least one or both of the latter juxtaposed surfaces in part or in entirety as desired of the third and fourth elements, respectively, is provided with the adhesive. This bonds the juxtaposed surfaces together to constitute a bielement unitary structure fastener 75 in FIG. 16. The third element in the inverted -shape position in FIG. 15 and the fourth element inverted from the position in FIG. 12 are mounted on the staple to dispose adjacent one and opposite surfaces of the respective latter elements in juxtaposition in the manner of the third element in the E-shape and the fourth element in the position in FIG. 12 as just explained. The latter juxtaposed surfaces are bonded together via the adhesive 61 to constitute a bielement unitary structure fastener 75 similar to fastener 59 shown in FIG. 7.

Figure 17:
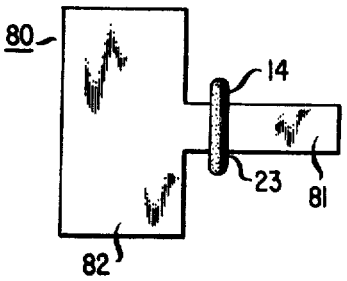
FIGS. 17 and 18 illustrate further modifications of the invention in FIGS. 3 and 4.
Figure 18:
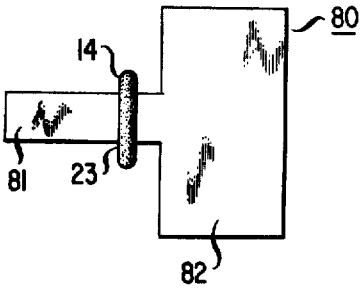

FIGS. 17 and 18 illustrate a further modification of the specific embodiment of the invention in FIGS. 3 and 4 in that both opposite surfaces of a fifth element 80 are plane. The latter element is usable in either a ⊢ -shape or a ⊣ -shape wherein an integral projection 81 of longer dimension in each latter shape is disposed in staple internal opening 23 while an integral projection 82 of smaller dimension is disposed exteriorly thereof. A sixth element, not shown, is provided with either the ⊢ -shape or the ⊣ -shape or a rectangular shape as suitable is disposed in juxtaposition with the fifth element. Otherwise, the fastener according to FIGS. 17 and 18 is constituted of bielement unitary structure essentially in the manner hereinbefore described for fasteners 59 and 75 in FIGS. 7 and 16, respectively. In this connection, it is understood the sixth element is formed with the opening 54, not shown, for passing the staple segment therethrough for mounting the sixth element exteriorly of the staple 14. Obviously, the projections 81 and 82 may be reversed in dimensions or provided with equal dimensions without impairing the fastener according to FIGS. 17 and 18.

While the several components of the respective elements of the invention are disclosed with squared edges, these are not necessarily essential; and the adhesive may be replaced by any suitable type of bonding. Rounded or similar edges are readily usable. Also, the several elements may be composed of a suitable material that tends to bond together under the stimulus of a brief application of heat thereto. In addition, while the invention is described relative to a pay telephone station coin box, it is not exclusively restricted thereto and may be used equally as well with containers of various sizes and shapes for storing jewels, works of art, and the like in hotels, art galleries and similar depositories. In addition, the several elements may be provided with a distinctive color or a combination of colors, or a single digit or a combination thereof to identify predetermined time periods during which the fastener is in use.

Therefore, it is understood that the invention herein is described in such respects as are illustrative of the operation thereof. Other arrangements may be devised by those skilled in the art without departing from the spirit and scope of the invention.

What is claimed is:

1. In combination with a security box containing articles of monetary value and provided with a staple including hasp having a first two spaced adjacent ends secured to one face of said box and a second two spaced adjacent opposite ends terminated in an integral curvilinear segment; said first and second two staple ends, said segment and said one box face determining a hollow space interiorly of said staple; said hasp also embodying a member having one end attached to a cover of said box at an area adjacent to said first two staple ends and an opposite end movable pivotally at said member one end; said member opposite end formed with a slit for receiving therethrough said segment and disposing said last-mentioned end adjacent to said staple first two ends and said box face to assemble said hasp on said box;

a fastener for locking said assembled hasp on said box to prevent unauthorized entry thereinto, comprising:

first means including an elongated rectilinear projection positioned in said staple hollow space to extend beyond opposite sides thereof adjacent to said member opposite end; and second means formed with an aperture for receiving said segment therethrough to extend beyond said second means to dispose said second means externally of said staple in juxtaposition with said first means to overlie said projection on said staple space opposite sides between said member opposite end and said last-mentioned sigment to form said fastener in a multimeans structure.

2. The combination according to claim 1 which includes an adhesive material supplied to at least one of said first and second means to bond both said latter means together in said juxtaposition in a unitary structure.

3. The combination according to claim 1 which includes an elongated rectilinear pin of hard substance embodied in said projection for reinforcing said projection to additionally prevent said unauthorized entry into said box.

4. The combination according to claim 1 which includes an elongated rectilinear pin of hard substance in said projection, and an adhesive material supplied to at least one of said first and second means for bonding both said latter means together in said juxtaposition in a unitary structure.

5. The combination according to claim 1 in which said first means includes two additional elongated rectilinear projections, each of which is disposed exteriorly of said staple on one side of said first-mentioned projection; said first-mentioned projection and said two additional projections being coextensive, mutually parallel and arranged in an E-shape in one plane.

6. The combination according to claim 1 in which said first means includes two additional elongated rectilinear projections, each of which is disposed exteriorly of said staple on one side of said first-mentioned projection; said first-mentioned projection and said two additional projections being coextensive, mutually parallel, and arranged in an ∃-shape in one plane.

7. The combination according to claim 1 in which: said first means also includes second and third elongated and rectilinear projections coextensive and parallel with said first-mentioned projection, each second and third projections being disposed on one lengthwise side of said first-mentioned projection; first and second elongated and rectilinear grooves and a first elongated rectilinear recess; said grooves and recess being parallel with each other and with said first-mentioned projection and said second and third projections; said first groove separating said first-mentioned projection and said second projection, said second groove separating said first-mentioned projection and said third projection; and said first recess being contiguous with a free lengthwise edge of said third projection; said second means includes fourth, fifth and sixth elongated and rectilinear projections coextensive and parallel with said first-mentioned projection and said second and third projections; third and fourth elongated and rectilinear grooves, and a second elongated rectilinear recess; said last-mentioned grooves and recess being parallel with each other and with said last-mentioned projections; said third groove separating said fourth and fifth projections, said fourth groove separating said fifth and sixth projections, and said second recess being contiguous with a free lengthwise edge of said sixth projection; said second means aperture dividing each of said fifth and sixth projections and said fourth groove into two parts; and said first and second means in said juxtaposition mating said first-mentioned projection with said divided fourth groove, said second and third projections with said second recess and said third groove, respectively; and said divided sixth and fifth projections with said first and second grooves, respectively, and said fourth projection with said first recess.

8. The combination according to claim 7 in which said first means projections including said first-mentioned projection and said second and third projections, said first and second grooves and said first recess form an E-shape as said first-mentioned projection is positioned in said staple hollow space.

9. The combination according to claim 7 in which said first means projections including said first-mentioned projection and said second and third projections, said first and second grooves and said first recess form an ∃-shape as said first-mentioned projection is positioned in said staple hollow space.

10. The combination according to claim 1 in which said corresponding mating projections, grooves and recesses of said first and second means in said juxtaposition include plane contiguous surfaces.

11. In combination with a security box containing articles of monetary value and provided with a hasp having first two-spaced adjacent ends secured to one face of said box and a second two-spaced adjacent opposite ends terminated in an integral curvilinear segment; said first and second two ends, said segment and said box face determining a hollow space interiorly of said staple; said hasp also embodying a member having one end attached to a cover of said box at an area adjacent to said staple first two ends and an opposite end movable pivotally on said member one end; said member opposite end formed with a slit for receiving therethrough said segment and disposing said last-mentioned end adjacent to said staple first two ends and said box face to assemble said hasp on said box;

means for fastening said assembled hasp on said box to prevent unauthorized entry into the interior thereof, comprising:

a first element formed with spaced first, second and third elongated, rectilinear and coextensive projections spaced in mutually parallel relation in a preselected shape in one plane; said second projection positioned in said staple hollow interior space and said first and third projections disposed exteriorly of said staple on opposite sides of said first projection; said first element being disposed adjacent to said member opposite end; and a second element formed with an aperture for passing said staple segment therethrough to dispose said second element externally of said staple in juxtaposition with said first element projections;

said first element projections and said second element having contiguous areas in said juxtaposition to constitute said fastening means in a bielement structure.

12. The combination according to claim 11 in which said first element preselected shape is an E-shape.

13. The combination according to claim 11 in which said first element preselected shape is an ∃-shape.

14. The combination according to claim 11 which includes an adhesive applied to at least one of said first and second elements for bonding said juxtaposed contiguous areas together to constitute said fastening means as a unitary bielement structure.

15. The combination according to claim 11 which includes an elongated pin of hard material embodied lengthwise in a lengthwise portion of said second projection in said staple space.

16. The combination according to claim 11 in which said juxtaposed first and second elements include said contiguous areas with plane surfaces.

17. The combination according to claim 11 in which: said first element is also formed with first and second rectilinear grooves and a first elongated, rectilinear recess; said grooves and recess arranged in mutually spaced relation so that said first groove separates said first and second projections, said second grooves separates said second and third projections, and said first recess is contiguous with a free lengthwise edge of said third projection; said grooves and said recess being parallel with said respective last-mentioned projections; said second element also formed with fourth, fifth and sixth elongated and rectilinear projections space in mutually parallel relation; third and fourth elongated and rectilinear grooves, and a second elongated and rectilinear recess; said last-mentioned grooves and recess arranged in mutually spaced relation so that said third groove separates said fourth and fifth projections, said fourth groove separates said fifth and sixth projections; and said second recess is contiguous with a free lengthwise edge of said sixth projection; said second element aperture dividing each of said fifth and sixth projections and said fourth groove into two parts; said last-mentioned grooves and recess being parallel with said last-mentioned projections; and said first and second elements in said juxtaposition mating said second projection with said divided fourth groove, said first and third projections with said second recess and said third groove, respectively; and said divided sixth and fifth projections with said first and second grooves, respectively; and said fourth projection with said first recess.

18. The combination according to claim 11 in which said first element preselected shape is an E-shape plane surface, and said second element includes a plane surface; said first and second element contiguous areas including both said last-mentioned plane surfaces in said juxtaposition.

19. The combination according to claim 11 in which said first element preselected shape is an ∃-shape plane surface, and said second element includes a plane surface; said first and second element contiguous areas including both said last-mentioned plane surfaces in said juxtaposition.

20. In combination with a pay telephone station coin box provided with a hasp having first two spaced adjacent ends secured to one face of said box and second two spaced adjacent opposite ends terminated in an integral curvilinear segment; said first and second two adjacent ends, said segment and said box face determining a hollow space interiorly of said staple; said hasp also embodying a member having one end attached to a cover of said box at an area adjacent to said first two adjacent ends and an opposite end movable pivotally on said member one end; said member opposite end formed with a slit for receiving therethrough said segment and disposing said last-mentioned end adjacent to said staple first two ends and said box face to assemble said hasp on said box;

means for fastening said assembled hasp on said box to prevent unauthorized entry into the interior thereof, comprising:

a first element formed with first, second and third elongated, rectilinear and coextensive projections arranged in a mutually parallel spaced relation and having corresponding surfaces in a first plane; first and second legs formed integrally with corresponding ends of said projections; said first leg joining said first and second projections to constitute a first groove therebetween and said second leg joining said second and third projections to constitute a second groove therebetween; said third projection having an elongated rectilinear recess formed along a free lengthwise edge thereof; said grooves and recess having corresponding surfaces in a second plane spaced from said first plane;

said first element disposed on said staple to position said second projection in said staple hollow interior space and said first and third projections, said grooves and first recess exteriorly of said staple for positioning said first element adjacent to said member end in a preselected shape with said last-mentioned projections, grooves and recess facing said segment;

a second element formed with fourth, fifth and sixth elongated, rectilinear and coextensive projections which are also coextensive with said first, second and third projections and arranged in a mutually parallel spaced relation and having corresponding surfaces in a third plane; said spaced fourth and fifth projections having a third groove constituted between opposing lengthwise edges thereof; said spaced fifth and sixth projections having a fourth groove constituted between opposing lengthwise edges thereof; said sixth projection having a second elongated recess formed along a free lengthwise edge thereof; said third and fourth grooves and said second recess having corresponding surfaces in a fourth plane spaced from said third plane; said second element including an elongated aperture provided lengthwise approximately on a central axis thereof to divide each of said fifth and sixth projections and said fourth groove into two parts;

said second element passing said staple segment through said aperture for disposing said second element exteriorly of said staple in juxtaposition with said first element and thereby said first and second planes in contiguous relation with said fourth and third planes, respectively, for mating said first, second and third projections with said second recess, and fourth and third grooves, respectively, and said fourth, fifth and sixth projections with said first recess and said second and first grooves, respectively;

said juxtaposed first and second elements bonded together at least at said first and second plane surfaces to constitute said fastening means in a bielement unitary structure.

21. The combination according to claim 20 in which said first element preselected shape is an E-shape.

22. The combination according to claim 20 in which said first element preselected shape is an ∃-shape.

23. In combination with a pay telephone station coin box provided with a hasp having first two spaced adjacent ends secured to one face of said box and second two spaced adjacent ends terminated in an integral curvilinear segment; said first and second two adjacent ends, said segment and said box face bounding a hollow space interiorly of said staple; said hasp also embodying a member having one end attached to a cover of said box at an area adjacent to said first two ends and an oppsite end movable pivotally on said member one end; said member opposite end formed with a slit for receiving therethrough said segment and disposing said last-mentioned end adjacent to said first two adjacent ends and said box face to assemble said hasp on said box;

means for fastening said assembled hasp on said box to thwart unauthorized entry thereinto, comprising:

a first element formed with first, second and third elongated, rectilinear and coextensive projections arranged integrally in a mutually parallel spaced relation in one plane; said element disposed on said staple to position said second projection in said staple hollow interior space and said first and second projections exteriorly of said staple; said element having one surface positioned adjacent to said member opposite end and an opposite surface facing said segment; said element disposed on said staple in a preselected shape;

a second element formed with an elongated aperture extending approximately centrally thereof on an axis of said second element; said second element disposed exteriorly of said staple by passing said segment through said sperture to position one surface of said second element in juxtaposition with said first element opposite surface; said last-mentioned one end opposite surfaces bonded together to constitute said fastening means in a bielement unitary structure.

24. The combination according to claim 23 in which said first element preselected shape comprises an E-shape in one plane.

25. The combination according to claim 23 in which said first element preselected shape comprises an ∃-shape in one plane.

26. The combination according to claim 1 in which said first means including said projection forms a ⊣-shape in one plane.

27. The combination according to claim 1 in which said first means including said projection forms a ⊢-shape in one plane.

* * * * *